US006457422B1

(12) United States Patent
Saul

(10) Patent No.: US 6,457,422 B1
(45) Date of Patent: Oct. 1, 2002

(54) GROMMET ASSEMBLY WITH HUTCH ATTACHMENT AND LATERAL WIRE ROUTING CAPABILITIES

(75) Inventor: Gregory Mark Saul, Charlotte, NC (US)

(73) Assignee: Jofco, Inc., Jasper, IN (US)

( * ) Notice: Subject to any disclaimer, the term of this patent is extended or adjusted under 35 U.S.C. 154(b) by 0 days.

(21) Appl. No.: 09/707,518

(22) Filed: Nov. 7, 2000

(51) Int. Cl.[7] ..... A47B 77/08

(52) U.S. Cl. ..... 108/50.02; 312/223.6; 312/196

(58) Field of Search ..... 312/223.6, 223.3, 312/194, 196; 108/50.02

(56) References Cited

U.S. PATENT DOCUMENTS

| | | | | |
|---|---|---|---|---|
| 4,053,701 A | | 10/1977 | Ogilvie et al. | |
| 4,163,867 A | | 8/1979 | Breidenbach | |
| 4,688,491 A | | 8/1987 | Herrera et al. | |
| 4,828,513 A | | 5/1989 | Morrison et al. | |
| 4,950,839 A | | 8/1990 | Quinn et al. | |
| 5,237,935 A | * | 8/1993 | Newhouse et al. | 108/50.02 |
| 5,429,431 A | * | 7/1995 | Olson et al. | 312/223.6 |
| 5,451,101 A | | 9/1995 | Ellison et al. | |
| 5,860,713 A | * | 1/1999 | Richardson | 312/223.6 |
| 6,047,508 A | | 4/2000 | Goodman et al. | |

FOREIGN PATENT DOCUMENTS

| | | | | |
|---|---|---|---|---|
| GB | 2245162 | * | 1/1992 | 312/223.6 |

* cited by examiner

*Primary Examiner*—Janet M. Wilkens
(74) *Attorney, Agent, or Firm*—Maginot, Moore & Bowman

(57) ABSTRACT

A grommet assembly for an article of furniture, such as a desk or credenza, which allows for an attachment to a hutch while also providing for the passage of wiring through the furniture surface on which the hutch is supported. The grommet assembly includes a grommet that line a hole formed in the edge of the furniture worktop. A lug projecting upwardly from the grommet above an upper surface of the worktop is adapted for attachment to a hutch supported on the worktop. The grommet defines wiring passageways within the hole, which accommodate wiring through the hole between spaces above, below, and outward, such as laterally, of the desktop. A removable top cover mountable to the grommet covers at least a portion of the hole at the upper surface of the worktop, and a removable side cover mountable to the grommet covers at least a portion of the hole at the edge surface of the worktop.

27 Claims, 7 Drawing Sheets

GROMMET ASSEMBLY WITH HUTCH ATTACHMENT AND LATERAL WIRE ROUTING CAPABILITIES

BACKGROUND OF THE INVENTION

The present invention relates to devices used to accommodate wiring within articles of furniture, and, in particular, to a grommet assembly installable in a hole in a horizontal surface of a furniture article and adapted for wiring passage.

Articles of furniture used in both the home and office often include a desk, table or credenza equipped with a set of overhead storage compartments or shelves that are conventionally known as a hutch. Especially in office environments where furniture is increasingly modular in design to allow ready reconfiguration depending on needs and available space, hutches are frequently provided as separate units, each of which units can be mounted on top of a horizontal worktop of a selected desk or the like. Specifically, a hutch unit is typically designed with vertical panels that extend down from the ends of the storage compartments and which are fastened to the desk for stability.

Many existing systems to fasten the hutch to the desk suffer from a variety of shortcomings including an unattractive appearance or an unstable mounting. For example, in some prior art furniture, the fastening system uses L-shaped or angled brackets having horizontal and vertical legs, which respectively attach to the desk and to a vertical end panel of the hutch. In some applications, the horizontal bracket leg is attached to the underside of the desktop, and the upstanding bracket leg extends along the edge surface of the desktop and is attached to the outside of the hutch panel. Besides being aesthetically unappealing when the furniture is positioned so that the vertical bracket is visible running up the side of the desktop, this bracket mounting can hamper the process of removing the hutch and installing it on another worktop during furniture reconfiguration. Accessing such a bracket to unfasten it from the desktop may require pulling the desk away from the wall or other article of furniture against which the desk is positioned. In other applications in which the horizontal bracket leg is attached to the top surface of the desktop, normally with the upstanding bracket leg attached to the inside of the hutch panel, removing the bracket during hutch relocation exposes unsightly screw holes in the top surface of the desktop.

In still other furniture, the fastening system uses double-sided tape between the top surface of the desktop and the bottom edges of the hutch vertical panels. However, the stability of such a mounting may be less than optimal for some situations.

Articles of furniture such as desks also are frequently designed to accommodate the multitude of cables or wiring associated with equipment supported on the desktop. Various grommet assemblies have been developed which line a hole formed in the desktop to accommodate cabling extending from devices such as computers, telephones and lighting equipment on the desktop. This cabling extends downward through the desktop to be linked to outlets or ports in the wall behind the desk. However, most furniture with grommet assemblies lacks the ability to readily pass the wires outward through the furniture to adjacent furniture pieces, such as passing wiring for communications and power systems between desks placed end-to-end. In some known designs that handle lateral wire routing, a grommet-lined hole is provided in the side panel of a desk to accommodate wiring from outward of the desk to the space underneath the desk. Another grommet-lined hole through the desktop allows wiring to extend to devices on top of the desk. Such a design, while perhaps functional, may be too expensive for some applications, as additional manufacturing steps may be required to form the holes, and multiple grommet assemblies need to be manufactured and installed in such holes.

Thus, it is desirable to provide an article of furniture with a grommet assembly that overcomes these and other shortcomings of the prior art.

SUMMARY OF THE INVENTION

The present invention provides a grommet assembly for an article of furniture, such as a desk or credenza, which allows for an attachment to a hutch while also providing for the passage of wiring through the furniture surface on which the hutch is supported. The grommet assembly is adapted to allow wiring passage not only between the spaces above and below a desktop or the like, but also to a space outward or laterally of the desktop.

In one form thereof, the present invention provides a grommet assembly for a furniture article having a top supported on a base, the top including an upper surface and a lower surface and defining a hole therethrough for wiring to extend between spaces above and below the top. The grommet assembly includes a grommet secured to at least one of the base and the top. The grommet defines a passageway for passage of wiring through the top hole. The grommet assembly includes a lug projecting upwardly from the grommet above the upper surface of the top, which lug is adapted for attachment to a hutch supported on the top.

In another form thereof, the present invention provides a grommet assembly for a furniture article having a top supported on a base, the top including an upper surface, a lower surface and an edge surface, the top further defining a hole extending inwardly from the edge surface and extending vertically through the upper and lower surfaces. The grommet assembly includes a grommet, a removable top cover, and a removable side covers. The grommet is disposed within the hole and secured to at least one of the base and the top.

The grommet defines a plurality of apertures, most preferably including a first aperture, a second aperture and a third aperture. The first aperture opens to the hole through the upper surface, the second aperture opens to the hole through the lower surface, and the third aperture opens to the hole through the edge surface. Each of the plurality of apertures opens into an interior volume of the grommet to communicate with the other of the plurality of apertures for wiring passage.

The removable top cover is mountable to the grommet to cover at least a portion of the hole at the upper surface of the top. The removable side cover is mountable to the grommet to cover at least a portion of the hole at the edge surface of the top. When mounted to the grommet, each of the removable top covers is removable from the grommet without removing the other cover.

In still another form thereof, the present invention contemplate an article of furniture including a support base, a top, a grommet and a lug. The top is supported on the support base and includes an upper surface, a lower surface and an edge surface. The top defines a hole extending inwardly from the edge surface and extending vertically through the upper and lower surfaces. The grommet is within the hole and secured to at least one of the support base and the top. The grommet is structured and arranged to define first and second wiring passageways within the hole. The first wiring passageway is arranged between the upper surface and the lower surface of the top, and the second wiring passageway is arranged between the edge surface of the top and at least one of the upper surface of the top and the lower surface of the top. The first wiring passageway accommodates wiring through the hole between a space above the upper surface and a space below the lower surface, and whereby the second wiring passageway accommodates wiring through the hole between a space outward of the edge surface and at least one of the space above the upper surface and the space below the lower surface. The lug projects upwardly from the grommet above the upper surface of the top and is adapted for attachment to a hutch supported on the top.

One advantage of the present invention is that a grommet assembly for a hole in a top surface of a desk or credenza is provided which is adapted for both wiring passage and mounting of a hutch on the top of such desk or credenza.

Another advantage of the present invention is that a grommet assembly with hutch attachment capabilities is provided that is easy to use, and readily convertible when no hutch is required to be secured.

Still another advantage of the present invention is that a grommet assembly is provided for routing wiring outwardly, such as laterally or rearwardly, through the edge surface of a worktop, and vertically through the top and bottom surfaces of the worktop.

DESCRIPTION OF THE FIGURES

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
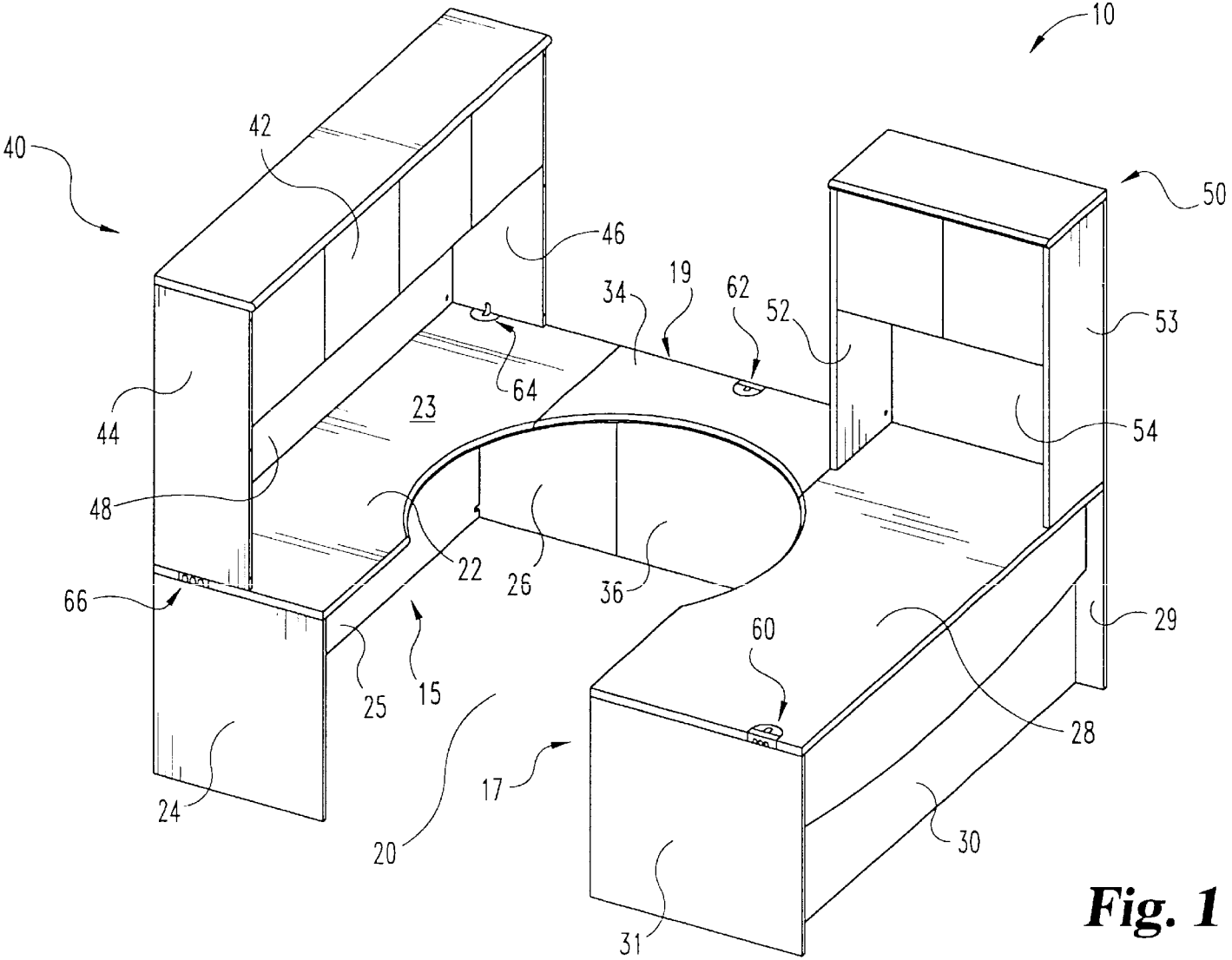
FIG. 1 is a perspective view of a workstation formed of articles of furniture equipped with multiple grommet assemblies in accordance with one embodiment of the present invention.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and further applications of the principles of the invention, which would normally occur to one skilled in the art to which the invention relates.

Referring now to FIG. 1, there is shown an office workstation incorporating multiple grommet assemblies configured in accordance with the present invention. The workstation, generally designated 10, is assembled from multiple articles of furniture, including a first desk unit 15, a second desk unit 17, and a transition section or return unit 19. With respect to each of the articles of furniture comprising workstation 10, any references to front, side, rear, left, right and the like are from the perspective of a user of the workstation located at work area 20 and facing the described furniture article.

Desk 15 includes a top or horizontal panel 22 supported above the floor on a pedestal or base, which in the illustrated embodiment is formed of a left side panel 24, a rear modesty panel assembly 25 and a right side panel 26. Desk 17 similarly includes top panel 28, left side panel 29, modesty panel assembly 30, and right side panel 31. Return 19 includes top panel 34 and back panel 36 that interconnect desktops 22 and 28, and side panels 26 and 29, respectively.

Supportably mounted on desktop 22 is a hutch, generally designated 40 that extend the width of the desk along its rear edge. The hutch 40 can include door-covered, overhead storage compartments 42 assembled on end panels 44, 46 and back panel 48 that downwardly extend and abut desktop upper surface 23. A smaller hutch 50 with vertical panels 52, 53 and back panel 54 can be supported on the left side of desk 17.

Other hutch designs, such as well-known configurations including one or more shelves or doorless compartments instead of the door covered compartments shown, may alternatively be supported on the desktops. Furthermore, the workstation configuration shown in FIG. 1 is illustrative and is not intended to be limiting, as various other types of furniture articles, such as a credenza or a table, may find beneficial application of the inventive grommet assembly.

Multiple grommet assemblies of the present invention are shown incorporated into the horizontal panels or worktops 22, 28 and 34 along various edges thereof. While the inventive grommet assemblies may be positioned along any and all of the edge surfaces of the various top panels of the furniture articles, the number and placement of such assemblies may be selected by one of ordinary skill in the art in view of the teachings herein and based on the number and types of hutches possible mounted by the assemblies, the flexibility in where such hutches can be mounted, and where wiring is to be routed. Grommet assembly 60 at the right edge of desktop 28 and shown in greater detail in FIG. 2, and grommet assembly 62 at the rear edge of return top panel 34, are each shown configured to accommodate wire routing therethrough. These grommet assemblies 60 and 62 do not include hutch attachment lugs since the hutch attachment capabilities of these assemblies are not being utilized for the selected workstation configuration. Grommet assembly 64 at the right edge of desktop 22 and shown in greater detail in FIG. 3, grommet assembly 66 at the left edge of desktop 22, and a grommet assembly at the left edge of desktop 28 (not visible in FIG. 1 since it is positioned behind hutch panel 53), are each configured to accommodate wiring passage as well as to attach to a desk-supported hutch in the manner described further below.

Figure 2:
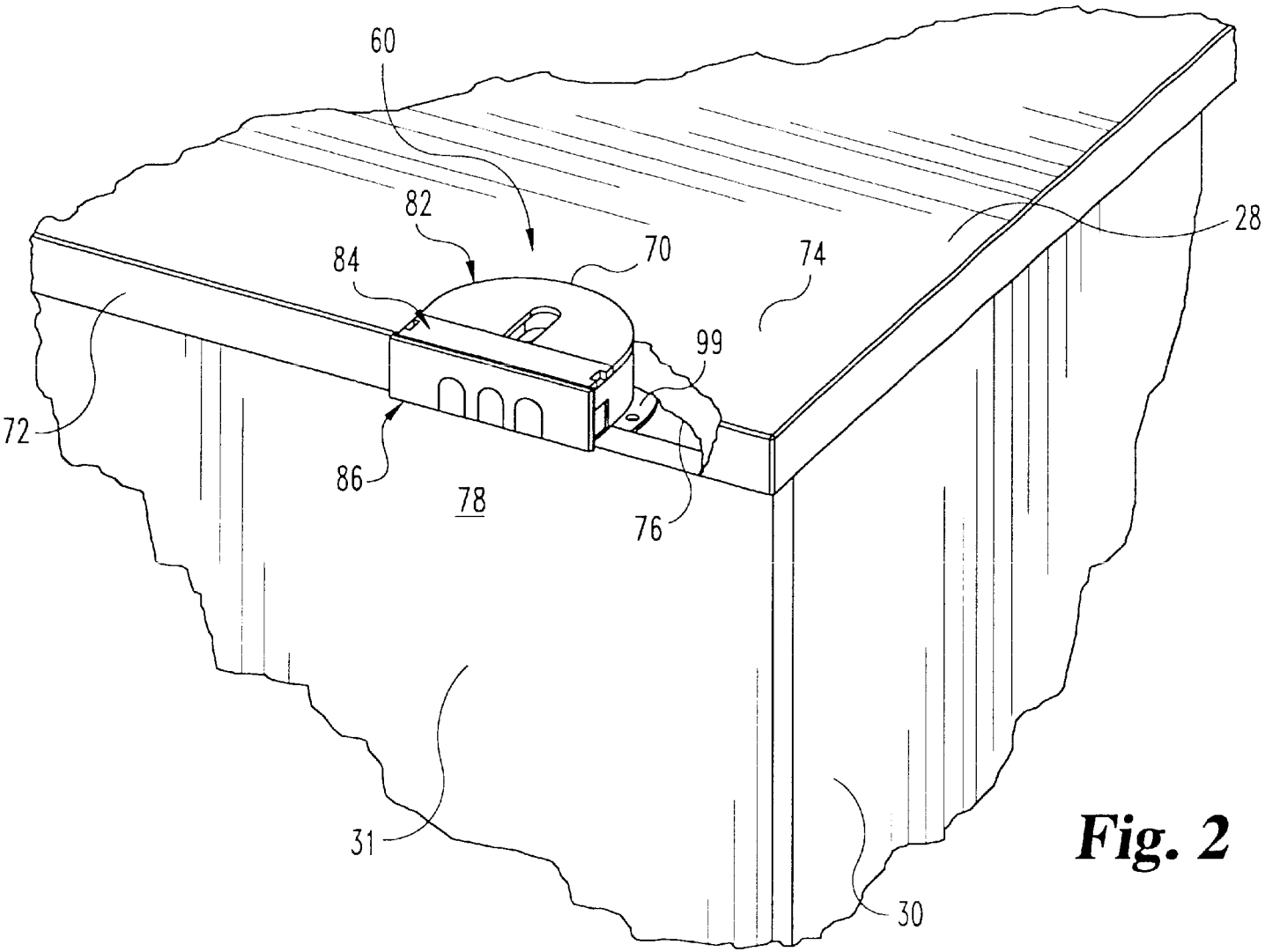
FIG. 2 is a fragmentary perspective view of a grommet assembly equipped desktop from FIG. 1 in which a portion of the desktop is broken away.

With reference now to FIG. 2, grommet assembly 60 is shown in greater detail incorporated into desktop 28 which has been partially cut away. A hole in the form of an inverted U-shaped slot 70 starts at and continues inwardly from an outward and laterally facing edge surface 72 of desktop 28. Slot 70 is formed through the entire height or thickness of desktop 28 and therefore extends between the upper surface 74 and the lower or bottom surface 76. In the shown embodiment, side panel 31 is aligned under the portion of desktop 28 adjacent edge surface 72 and with its outer face 78 generally flush with edge surface 72, but in alternate embodiments, may be spaced inwardly from that edge surface.

Figure 4:
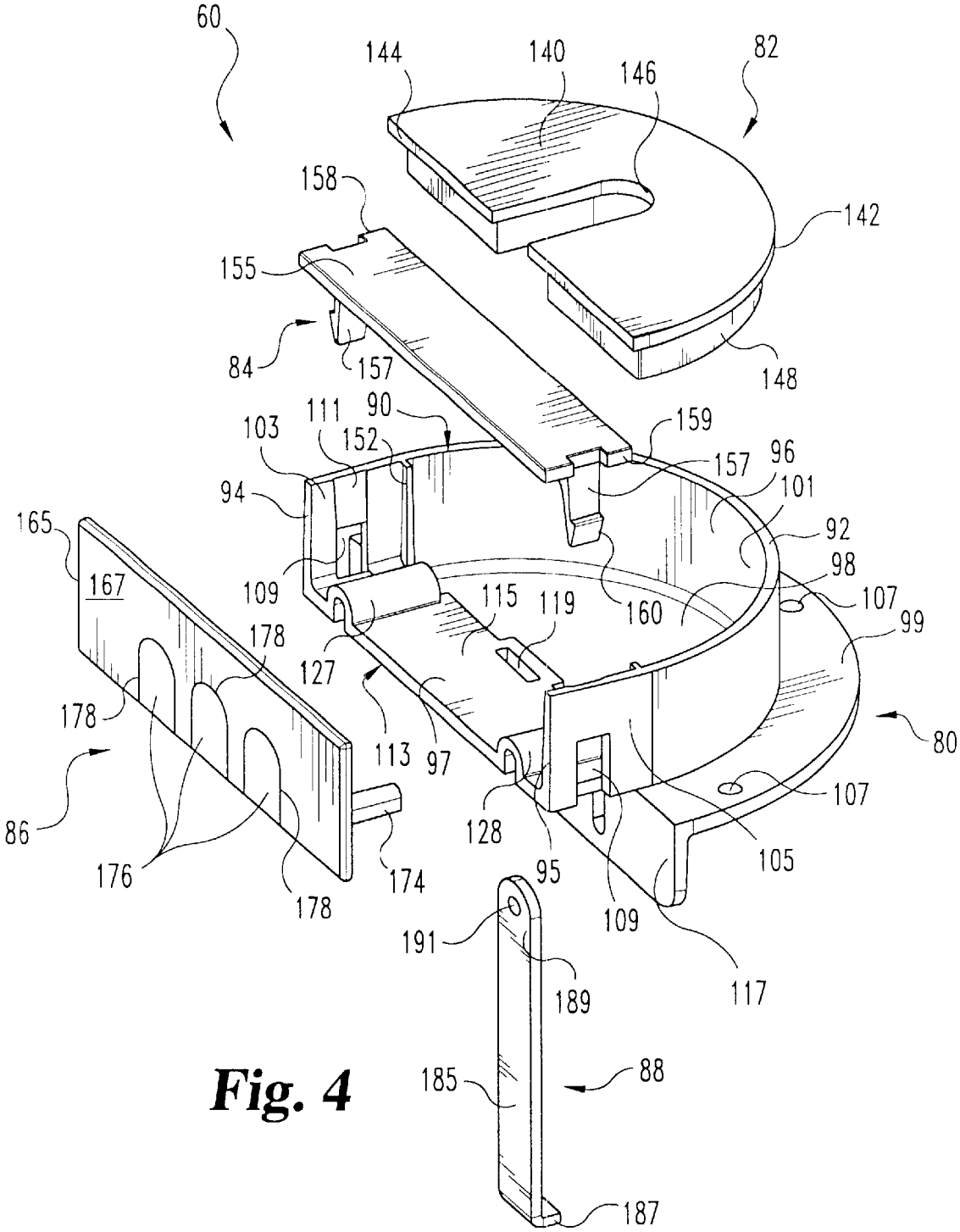
FIG. 4 is an exploded view of a grommet assembly prior to its incorporation into an article of furniture.

Grommet assembly 60 includes a grommet main body 80, a removable top cover 82, a fixed top cover 84 and a removable side cover 86. Each component of the assembly is preferably constructed of a high-strength and low-weight material, such as plastic or a glass-filled nylon composite. Other materials of construction, including metal, may also be used. Grommet assembly 60 is as shown in FIG. 4, the assembly 60 can include an associated hutch-attaching bracket or lug 88, that is preferably made of a metal, such as steel. Bracket 88 is not used as part of grommet assembly 60 in FIG. 1 due to the absence of a hutch panel over grommet assembly 60 requiring attachment. However, upon reconfiguration of the office furniture, if a hutch panel is arranged along the right edge of desk 17, a bracket 88 can be retrieved and used as part of grommet assembly 60.

Figure 5:
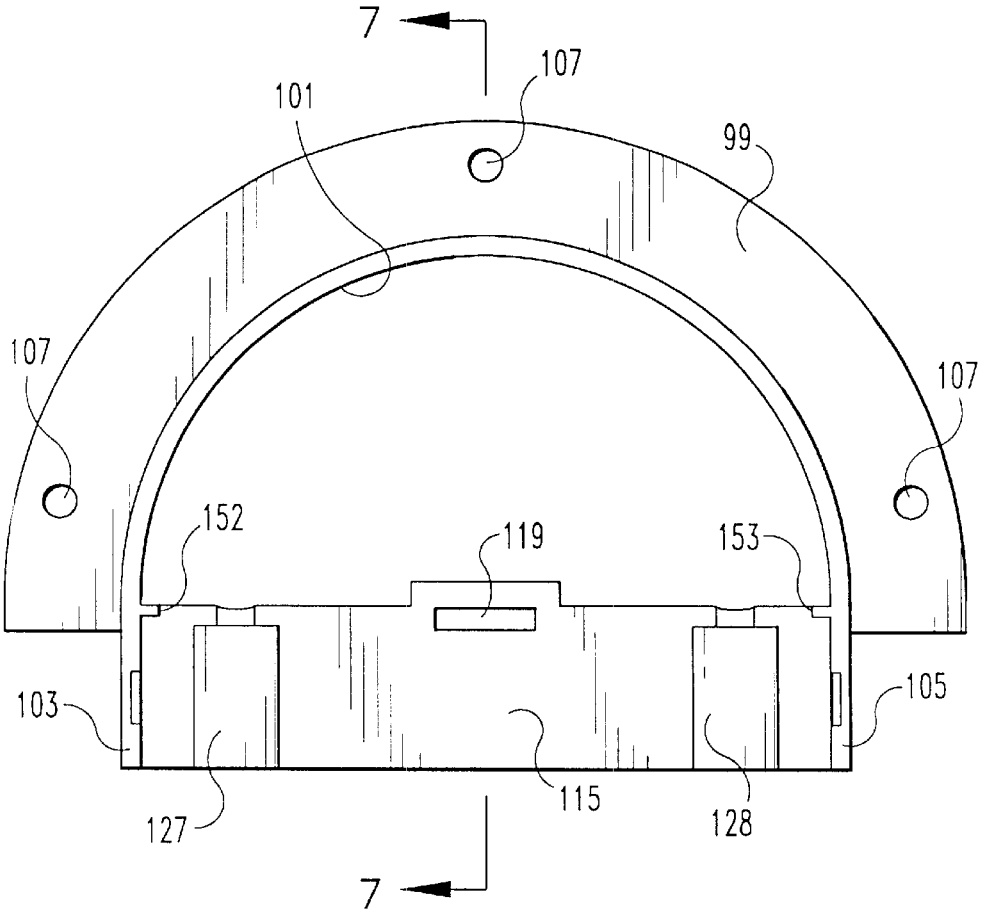
FIG. 5 is a plan view of the grommet main body of FIG. 4 separate from the grommet assembly.
Figure 6:
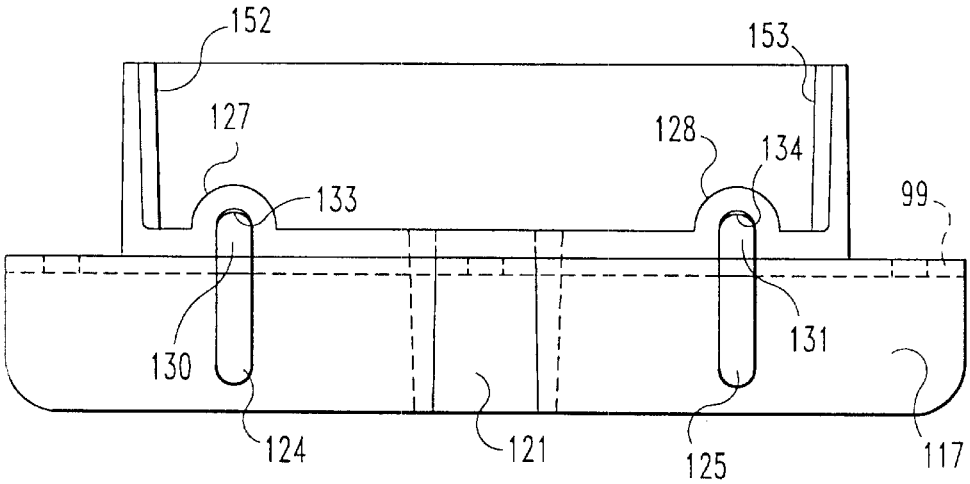
FIG. 6 is an elevational view of the grommet main body of FIG. 5.
Figure 7:
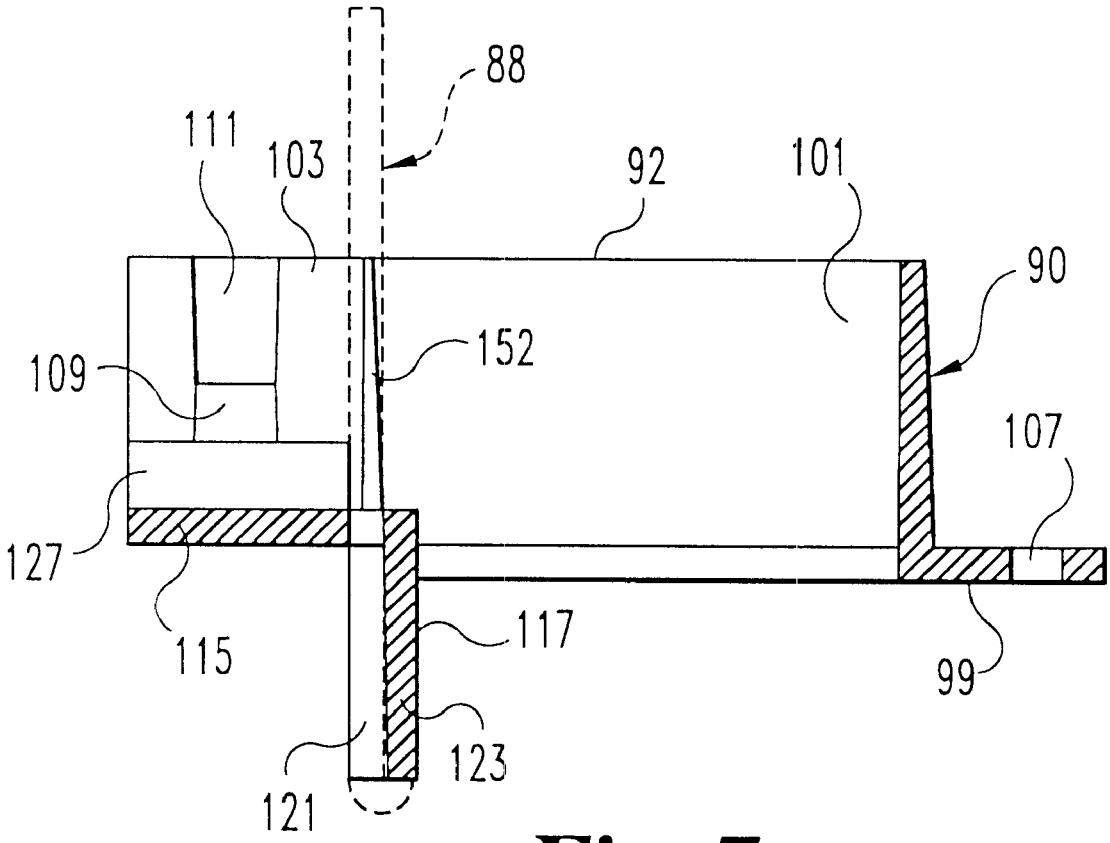
FIG. 7 is a cross-sectional view taken along line 7—7 of FIG. 5, with a hutch attaching bracket used therewith shown in dashed lines.

As further shown in FIGS. 5–7, grommet main body 80 is most preferably formed in one-piece such as through a die casting process. The body 80 has an upstanding flange 90 arranged in a U-shape in a horizontal plane. Upstanding flange 90 closely conforms to the size and shape of slot 70 formed in the desk 17 so that it can closely line that slot when incorporated into the desk. In the preferred embodiment flange 90 extends along nearly the entire height and essentially the entire length of the slot 70. In this arrangement, flange upper edge 92 (FIG. 4) is slightly recessed from desktop top surface 74, and the outward facing edges 94 and 95 (FIG. 4) of the flange ends are preferably generally flush with desktop edge surface 72. This slight recessing of edge 92 is designed in conjunction with top covers 82 and 84 such that the covers are substantially flush with top surface 74 when assembled to grommet main body 80.

The space ringed by upstanding flange 90 provides an open interior volume of the grommet main body 80 serves as a passageway through which wiring can be routed. The grommet interior volume is accessible from above through an aperture 96 defined by the upper edge 92 of flange 90, from the side through an aperture or gap 97 between the outward facing edges 94 and 95 of the flange ends, and from below through an aperture 98 defined by the bottom edge of flange 90 and the inward face of a crossmember 113 spanning between edges 94 and 95. Wiring can be selectively routed through the apertures 96–98 and within the interior volume to allow wires to pass between the spaces above and below the desktop, and between the spaces outward of and below or above the desktop, depending on the needs of the user.

A mounting flange 99 transversely extends from the bottom edge of flange 90 along the semi-circular length segment 101 of flange 90 that fits within the rounded end of slot 70, and along the inwardmost portion of the parallel end length segments 103 and 105 of flange 90. Mounting flange 99 fits under desktop bottom surface 76 and includes circular openings 107 spaced along its arc-shaped length which accommodate fasteners (not shown), such as screws, which can be inserted from below to fix flange 99 against desktop bottom surface 76 and secure the grommet main body 80 to desktop 28.

End segments 103 and 105 of flange 90 each include a means for attachment of top cover 84. In the illustrated embodiment, the attachment means for each flange segment includes a rectangular opening 109 in a bottom region of the flange height. A ramped region 111 formed as a thinning of the flange thickness moving upward along the flange height extends between opening 109 and the flange upper edge 92.

At the bottom edge of flange 90, a bracket supporting crossmember, generally designated 113, spans flange end segments 103 and 105. Crossmember 113 includes a top portion 115 from which downwardly extends a plate-shaped portion 117. In the preferred embodiment this portion 117 is used to attach the grommet main body 80 to the furniture base. The upper regions of the opposite ends of plate portion 117 merge into the mounting flange 99. A rectangular slot-shaped opening 119 through top portion 115 is aligned over a hollow 121 (FIG. 6) defined by a square stepped offset section 123 (FIG. 7) of plate portion 117. Vertically aligned slots 124 and 125 in plate portion 117 accommodate outwardly extending fasteners (not shown), such as screws, which press plate portion 117 against the inner face of side panel 31 to secure grommet main body 80 to the desk.

Crossmember 113 also includes at least one, and preferably two, attachment members used in mounting removable side cover 86 to grommet main body 80. In the preferred embodiment, the attachment members are formed as half cylindrical or arched regions 127 and 128 (FIGS. 5 and 6) of the otherwise plate shaped top portion 115. Arched regions 127 and 128 define downwardly opening, rounded hollows 130 and 131 (FIG. 6). The undersides of the arched regions 127 and 128 include a radially extending rib 133, 134, respectively, near the center of the axial length of the arched regions. These ribs 133, 134 project within hollow 130 or 131 to better engage rods 173 and 174 (FIG. 4) projecting from side cover 86 in a friction fit within the hollows. Other types of attachment members, such as by screws, may naturally be substituted by one of skill in the art for the hollow arched region shown.

Figure 8:
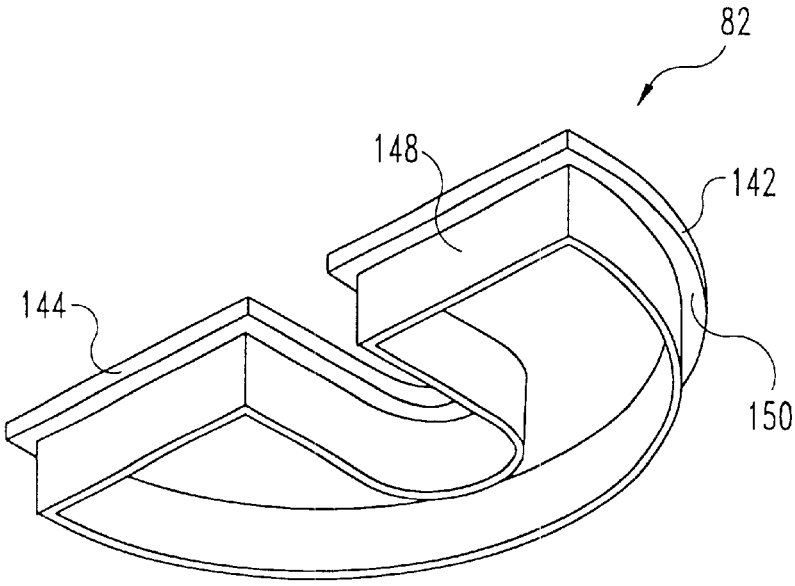
FIG. 8 is a bottom perspective view of the removable top cover of FIG. 4 separate from the grommet assembly.

As best shown in FIGS. 4 and 8, top cover 82 is formed with a top plug piece 140 having a planar top surface, a semi-circular inward edge 142 and a flat outward edge 144. Edge 144 includes a notched portion 146 that defines an opening through cover 82 for the passage of wiring therethrough. Although shown as being an inverted-U shaped slot in FIG. 4, the notch-defined opening may be alternatively configured, such as arcuate or squared, within the scope of the invention. A depending ridge 148 formed on the underside of plug piece 140 extends around the cover perimeter in spaced apart relationship with inward edge 142 and outward edge 144. The thickness of plug piece 140 and the shape of ridge 148 are designed in conjunction with upstanding flange 90 such that when top cover 82 is inserted into slot 70 from above, the underside 150 of plug piece 140 adjacent inward edge 142 is supported on upper edge 92 of flange 90. The plug piece 140 then fills the inward region of slot 70 with the upper surface of piece 140 substantially flush with desktop surface 74. When plug piece 140 is so seated vertically aligned ribs 152 and 153 on flange 90 engage ridge 148 to prevent plug rotation.

Fixed top cover 84 includes a rectangular top plate 155 having a thickness preferably equal to that of plug piece 140. A resilient prong 157 extends downwardly from each of ends 158 and 159 of top plate 155 and includes a flange-facing tooth 160. A notch shown in each of plate ends 158 and 159 above prong 157 is not functional, but facilitates the molding of the cover 84 in the shown configuration. A not shown pair of ribs extending the length of plate 155 between prongs 157 can be molded into the underside of plate 155 for rigidity.

As cover 84 is inserted from above onto grommet main body 80, the angled head of each tooth 160 engages a ramped region 11 such that prong 157 is bent toward the middle of the plate length. When sufficiently lowered, due to the elasticity of prong 157, each tooth 160 snaps into a rectangular opening 109 to secure top cover 84 to main body 80. When so secured, the underside of top plate 155 is seated on the upper edge 92 of flange 90, with top plate 155 filling the outward region of slot 70 and in generally abutting relationship with the outward edge 144 Of top cover 82, and with the upper surface of plate 155 substantially flush with desktop surface 74. The resiliency of top cover 84 afforded by its material of construction allows a user to slightly bend top cover 84 to withdraw teeth 160 from openings 109 to remove cover 84 from grommet assembly 80 if desired.

Figure 9:
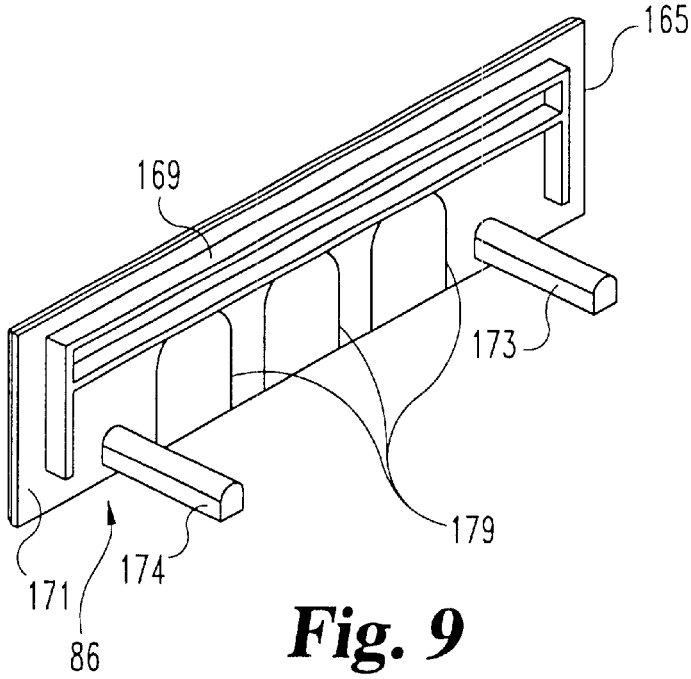
FIG. 9 is a perspective view of the removable side cover of FIG. 4 separate from the grommet assembly.

As best shown in FIGS. 4 and 9, removable side cover 86 has a rectangular face plate 165 with a planar outward surface 167. Reinforcing ribs 169 project from the inward surface 171 of faceplate 165. First and second mounting rods 173 and 174, which can have an inverted U-shaped in vertical cross-section, project honizontally from inward surface 171. The periphery of rods 173 and 174 are sized and configured to allow insertion into hollows 130 and 131 to achieve a friction fit with arched regions 127 and 128 to removably attach side cover 86 to grommet main body 80.

To allow cabling access through an installed side cover 86, knockout sections 176 of face plate 165 which are removable are provided between rods 173 and 174. Although three knockouts 176 are shown, other numbers as few as one and greater than three, may be employed within the scope of the invention. Each knockout 176 is preferably defined by a shallow V-shaped groove 178 cut into outward surface 167 in an inverted U-shaped pattern starting at the bottom plate edge, and by an aligned shallow V-shaped groove 179 cut into inward surface 171. In alternate embodiments, knockouts 176 can be otherwise scored to be snapped out manually, or provided as a reduced thickness portion of the plate, which are cut out by a user.

Figure 3:
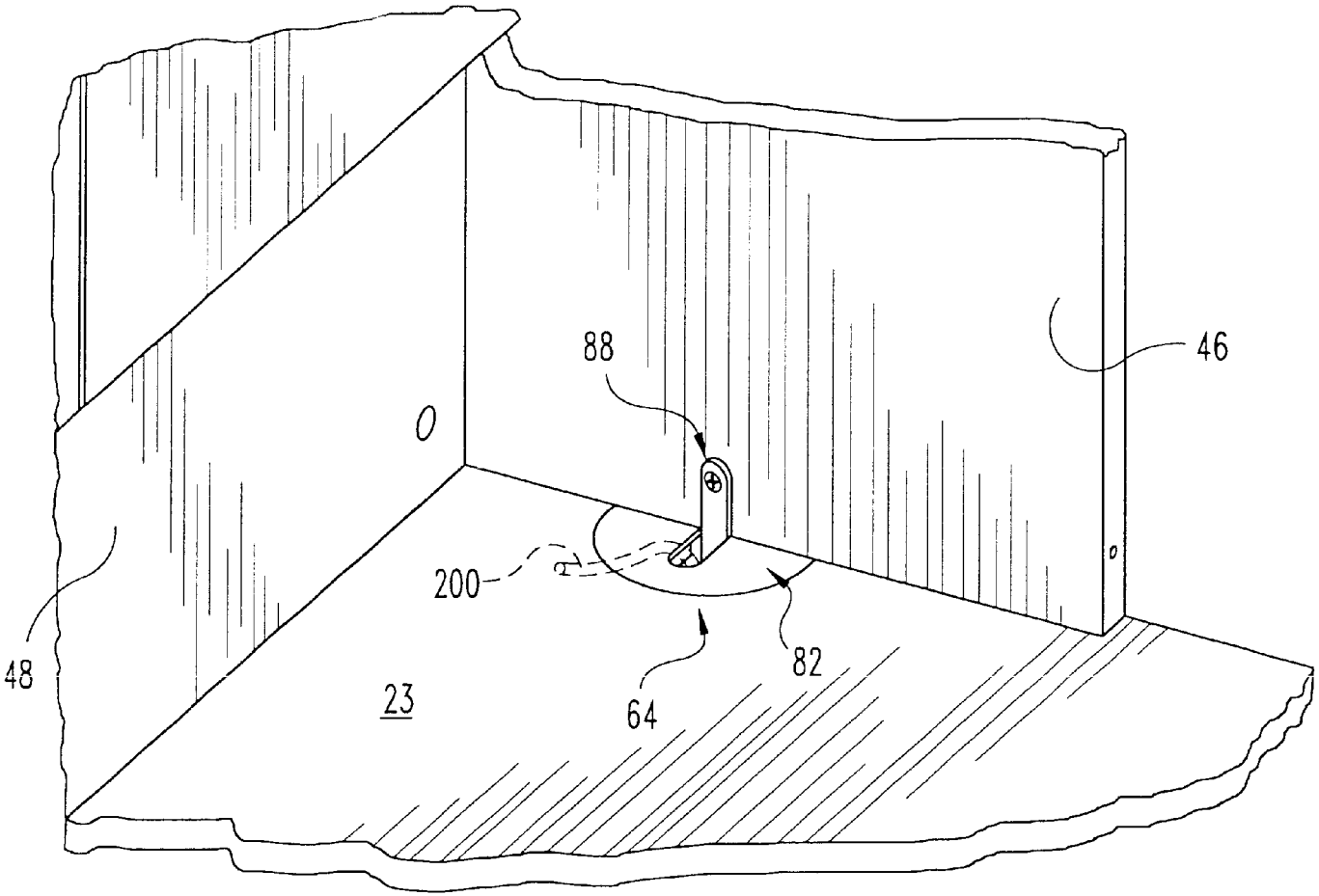
FIG. 3 is a fragmentary perspective view of another grommet assembly equipped desktop from FIG. 1 in which the grommet assembly is arranged in a hutch-attaching configuration.

Referring again to FIG. 4, bracket 88 serves as an upstanding lug usable to fasten overhead storage units to the top of a furniture article. The bracket is used with the grommet assembly 64 shown n FIG. 1. Bracket 88 includes an upstanding bar-shaped body 185 with an inwardly extending lip 187 formed as a bend in the lower end of body 185. Lip 187 is adapted to abut and thereby engage the underside of grommet main body 80, and particularly the underside of offset section 123 (FIG. 7) of crossmember plate portion 117, when the upper tip portion 189 of bracket body 185 is fully inserted upwardly through slot 119. Lip 187 prevents bracket 88 from being completely pulled through slot 119. Body 185 is sized and shaped to closely fit within hollow 121 of offset section 123. Opening 191 in tip portion 189 accommodates a fastener, such as a screw (FIG. 3), which can be inserted outwardly therethrough to attach a vertical hutch panel to bracket 88. Other known forms of attaching the bracket to a panel, such as a tack or nail, may alternatively be employed. When disposed in grommet main body 80 for hutch attachment, bracket 88 can be arranged as shown in dashed lines in FIG. 7. When so arranged, and in the manner shown in FIG. 3 illustrating grommet assembly 64, bracket body 185 extends through opening 146 of removable top cover 82.

The structure of the inventive grommet assemblies will be further understood in view of the following explanation of the installation and operation of grommet assembly 60. During manufacture of desk 17, prior to attaching side panel 31 to desktop 28, grommet main body 80 is secured within slot 70 with fasteners through mounting flange 99. When side panel 31 is typically otherwise attached to desktop 28, grommet main body 80 is also secured to side panel 31 with fasteners through plate portion 117. It will be appreciated that grommet assembly 60 thus serves as an additional fastening element between the desktop and support base.

Wire accommodating top cover 82, fixed cover 84 and side cover 86 are subsequently each mounted to grommet main body 80 as described above, resulting in grommet assembly 60 being arranged as shown in FIG. 2. When wiring is to be routed through grommet assembly 60, top covers 82 or side cover 86 can be removed as needed. For example, if desk 17 is placed end-to-end with another piece of furniture and a power line is to be routed therebetween, side cover 86 is removed completely, the power line is laterally inserted through grommet base aperture 97 and into the grommet interior volume, and the power line further is routed from the interior volume through aperture 98 or 96 to respectively reach the space below or above the desktop 28 where desired. It will be appreciated that if the power line is routed to the space above desktop 28, top cover 82 can be removed to facilitate the wiring passage through aperture 96, and then reinstalled on grommet main body 80 with the power line fitting through opening 146 when the wire routing process is completed.

In situations where desk 17 is not placed end-to end with other furniture, but the grommet assembly 60 is used to connect wiring from above or below the desktop 28 to a space laterally of the desk, after the wire routing process is complete the side cover 86 can be removed. After removing one or more knockouts 176 as appropriate from face plate 165, side cover 86 can be remounted to grommet main body 80 with the one or more wires passing through the cover openings created by knockout removal. Wire passage between spaces above and below desktop 28 can be performed by removing top cover 82 and passing the wiring within panel slot 70 through grommet main body 80 in a known fashion, and then reinstalling cover 82 on grommet main body 80 with the power wire fitting through cover opening 146 when the wire routing process is completed. All of this wring through the grommet body can occur with a hutch mounted to the desk, or more particularly with the bracket 88 passing through the body 80 and attached to the hutch.

If grommet assembly 60 is to be used to mount on desk 17 a hutch having a panel which is overlaid on top cover 84 assembled to grommet main body 80, without requiring removal of top cover 82 or side cover 86, bracket 88 is upwardly inserted from below into hollow 121 and through slot 119. It will be appreciated that body 185 will be captured between the inner face of side panel 31 and crossmember offset section 123 to limit the range of motion of bracket 88. After bracket 88 is pulled upward until lip 187 abuts crossmember offset section 123, and with body 185 flanking the vertical hutch panel, a fastener is inserted through hole 191 to secure the hutch panel to bracket 88. When the hutch is so secured, the grommet assembly is arranged as shown in FIG. 3, and wiring such as shown in dashed lines at 200 may be routed through the grommet assembly in the same manner as described with reference to grommet assembly 60. If the hutch is to be eliminated, the fastener through bracket 88 is simply removed, and bracket 88 is withdrawn from below, leaving the grommet assembly arranged as shown in FIG. 2.

While the invention has been illustrated and described in detail in the drawings and foregoing description, the same is to be considered as illustrative and not restrictive in character. It should be understood that only the preferred embodiments have been, shown and described and that all changes and modifications that come within the spirit of the invention are desired to be protected.

What is claimed is:

1. A grommet assembly for a furniture article having a top supported on a base, the top including an upper surface and,a lower surface and defining a hole therethrough for wiring to extend between spaces above and below the top, the furniture article further having a hutch supported on the top, the grommet assembly comprising:

a grommet disposable within the hole in the top and securable to at least one of the base and the top, said grommet defining a passageway for passage of wiring through the top hole; and a bracket projecting through said passageway and upwardly from said grommet above the upper surface of the top, said bracket having an end configured for attachment to the hutch supported on the top.

2. The grommet assembly of claim 1 wherein said grommet includes an upstanding flange lining the hole, and a crossmember that horizontally spans opposite first and second portions of said flange, said crossmember defining an opening to receive said bracket therethrough.

3. The grommet assembly of claim 2 wherein said bracket includes an upstanding bar defining an opening through an upper end portion for receiving a fastener therethrough, and a lip of at a lower end portion adapted to engage said crossmember to resist upward withdrawal of said bracket through said crossmember opening.

4. The grommet assembly of claim 3 wherein said cross ember includes a depending portion, said depending portion having an offset section that defines a hollow sized to receive said bar of said bracket.

5. The grommet assembly of claim 4 wherein said depending portion includes a plate defining a plurality of openings for accommodating fasteners for securing said plate to the base.

6. The grommet assembly of claim 1 further comprising a removable cover for the top hole, said cover seatable on said grommet with a top surface generally flush with the top upper surface, said cover defining a notched edge defining an opening for wiring passage.

7. A grommet assembly for a furniture article having a top supported on a base, the top including an upper surface, a lower surface and an edge surface, the top further defining a hole extending inwardly from the edge surface and extending through the upper and lower surfaces, the grommet assembly comprising:

a grommet disposable within the hole and securable to at least One of the base and the top, said grommet defining a plurality of apertures including a first aperture, a second aperture and a third aperture, said first aperture opening to the hale through the upper surface, said second aperture opening to the hole through the lower surface, and said third aperture opening to the hole through the edge surface, each of said plurality of apertures opening into an interior volume of said grommet to be in communication with the other of said plurality of apertures for wiring passage;

a removable top cover mountable to said grommet to cover At least a portion of the hole at the upper surface of the top;

a removable side cover mountable to said grommet to cover at least a portion of the hole at the edge surface of the top; and a bracket projecting upwardly from said grommet above the upper surface of the top, said bracket having an end configured for attachment to a hutch supported on the top.

8. The grommet assembly of claim 7 wherein said grommet includes an upstanding flange lining the hole, and a crossmember that horizontally spans first and second portions of said flange, said crossmember defining an opening to receive said bracket therethrough.

9. The grommet assembly of claim 8 wherein said crossmember comprises a top plate portion and a depending plate portion, wherein said crossmember opening is located in said top plate portion, said depending plate portion having an inwardly offset section that defines a hollow sized to receive a portion said bracket.

10. The grommet assembly of claim 9 wherein said depending plate portion includes a plurality of openings for accommodating fasteners for securing said depending plate portion to the base.

11. The grommet assembly of claim 7 wherein said grommet includes an upstanding flange lining the hole, and a mounting flange transversely extending openings for accommodating fasteners for securing said mounting flange to the top.

12. The grommet assembly of claim 11 further comprising a cover member for covering at least a portion of the hole at the upper surface of the top, said cover member including downwardly extending prongs attachable to complementary shaped portions of said upstanding flange, said cover member located outward of said removable top cover and adjacent the edge; surface of the top, wherein said removable top cover covers the inward end of the hole and includes an outward edge adjacent said cover member, said outward edge notched to define a wiring accommodating opening.

13. The grommet assembly of claim 3 wherein said removable side cover includes a plurality of knockout sections which when removed allow for wiring passage.

14. An article of furniture comprising:

a support base, wherein said support base includes a vertical panel;

a top supported on said support base, said top including an upper surface, a lower surface, an edge surface and a region adjacent said edge surface aligned over said vertical panel, the top further defining a hole extending inwardly from said edge surface and extending through the upper and lower surfaces;

a grommet within the hole and secured to at least one of said support base and said top, said grommet structured and arranged to define first and second wiring passageways within the hole said wiring passageway arranged between said upper surface and said lower surface of said top, said second wiring passageway arranged between said edge surface of said top and at least one of said upper surface of said top and said lower surface of said top, whereby said first wiring passageway accommodates wiring through said hole between a space above said upper surface and a space below said lower surface, and whereby said second wiring passageway accommodates wiring trough said hole between a space outward of said edge surface and at least one of said space above said upper surface and said space below said lower surface, said grommet further including an upstanding flange lining said hole and a crossmember that horizontally spans first and second portions of said upstanding flange, said crossmember including a plate section extending below said upstanding flange and having a plurality of openings for accommodating fasteners that secures said plate section to said vertical panel.

15. The article of furniture of claim 14 wherein said crossmember defines an opening through which extends said lug, said lug comprising an upstanding bar with a fastener receiving opening through an upper end portion, and wherein said lug comprises a lip of said bar adapted to engage said crossmember to resist upward withdrawal of said lug through said crossmember opening.

16. The article of furniture of claim 14 further comprising a removable top cover mountable to said grommet to cover at least a portion of said hole at said upper surface of said top, and a removable side cover mountable to said grommet to cover at least a portion of said hole at said edge surface of said top.

17. The article of furniture of claim 16 wherein said removable side cover includes a plurality of knockout sections which when removed allow for wiring passage.

18. A grommet assembly for a furniture article having a top supported on a base, the top including an upper surface and lower surface and defining a hole therethrough for wiring to extend between spaces above and below the top, the furniture article further having a hutch supported on the top, the grommet assembly comprising:

grommet including an upstanding flange disposable within the hole in the top and defining a passageway for passage of wiring therethrough, said grommet including a cross ember that spans opposite portions of said flange, said crossmember defining an opening therethrough; and bracket having an upstanding bar configured to extend through said opening in said crossmember, an end of said bar configured for attachment to the hutch supported on the top and ad opposite end of said bar configured to engage said crossmember to resist withdrawal of said bracket through said crossmember opening.

19. The grommet assembly of claim 18, wherein said opposite end of said bar defines a lip sized to prevent withdrawal through said opening in said crossmember.

20. The grommet assembly of claim 18 wherein said grommet includes a plate extending from said upstanding flange and sized to contact a surface of the top surrounding the hole in the top of the article of furniture.

21. The grommet assembly of claim 20 wherein said plate defines a plurality of openings for accommodating fasteners for securing said plate to the base.

22. The grommet assembly of claim 20, wherein said plate is arranged to contact the lower surface of the top.

23. A grommet assembly for an article of furniture having a top supported on a base and a hutch supported on the top, the top defining a hole therethrough to receive wiring passing therethrough, said grommet assembly comprising:

a hollow grommet sized to be received within the hole in the furniture top, said grommet defining at least one opening for passage of wiring therethrough; and elongated bracket having one end configured to extend through said at least one opening for attachment to the hutch and an opposite end configured to engage said grommet to prevent withdrawal of said bracket through said at least one opening.

24. The grommet assembly of claim 23 wherein said grommet includes:

an upstanding flange sized to be received within the hole; and a portion extending from said upstanding flange and sized to contact a surface of the top surrounding the hole in the top of the article of furniture.

25. The grommet assembly of claim 24, wherein said portion is a plate extending from said upstanding flange.

26. The grommet assembly of claim 25, wherein said plate is arranged to contact the lower surface of the top.

27. The grommet assembly of claim 24, wherein said one end of said bracket is an elongated bar and said opposite end of said bracket is a lip projecting substantially perpendicularly from said bar.

* * * * *